United States Patent [19]

Connelly

[11] 4,052,878

[45] Oct. 11, 1977

[54] TUBE BENDING APPARATUS

[76] Inventor: Dennis E. Connelly, 3305 S. Clermont, Denver, Colo. 80222

[21] Appl. No.: 710,728

[22] Filed: Aug. 2, 1976

[51] Int. Cl.[2] ..... B21D 7/04

[52] U.S. Cl. ..... 72/293; 72/157

[58] Field of Search ..... 72/293, 296, 297, 149, 72/157, 159, 217, 219, 458, 459, 36, 461, 307

[56] References Cited

U.S. PATENT DOCUMENTS

| | | | |
|---|---|---|---|
| 3,299,681 | 1/1967 | Hautau | 72/7 |
| 3,336,776 | 8/1967 | Zerlaut | 72/14 |
| 3,388,573 | 6/1968 | Presley, Jr. | 72/7 |
| 3,462,985 | 8/1969 | Troyanski | 72/22 |

*Primary Examiner*—Michael J. Keenan

*Attorney, Agent, or Firm*—Edwin L. Spangler, Jr.

[57] ABSTRACT

This invention relates to a novel tubing bender characterized by a horizontal bed atop which is mounted a template and a fixed block mounting a hollow tubular slide member for non-rotatable longitudinal slidable movement. The tube, in turn, mounts a longitudinally adjustable combination stop and slide support mechanism which selectively engages notches in the template to maintain the tube in longitudinally adjusted position relative to the block. A bending head is mounted on the end of the tubular member for rotatable adjustment relative thereto. The tube is slotted longitudinally both top and bottom to house internally an externally actuated vise mechanism that remains fixed relative to the block atop which it is mounted while the tube and bending head move as a unit longitudinally thereof. The vise mechanism releasably clamps a tubular workpiece passed through the tube in fixed spaced relation to the bending head, the spacing therebetween having been preset by the position of the stop in a selected notch in the template. The bending head has interchangeable dies which control both the radius and angle of the bend. The forming die that comprises a part of the bending head has a grooved block mounted thereon for limited relative longitudinal slidable movement thus defining a lost motion connection operative to free the head from the workpiece during the return or retraction stroke.

13 Claims, 9 Drawing Figures

TUBE BENDING APPARATUS

Pipe and tubing benders of one type or another have been around for a long time. Some are quite simple, manually operated tools that do quite an adequate job especially when the various bends require no critical spacing therebetween and where only one or at most a few workpieces of a kind need be made. The problem arises when dozens of essentially identical workpieces need to be fabricated, especially complicated ones having several bends bearing a precise relationship to one another. While the prior art discloses many solutions to this problem among which are U.S. Pat. Nos. 369,013; 3,553,990; 3,557,586; 3,650,140; 3,785,192; and 3,788,116, so far as applicant is aware, no one before him has adopted the particular solution he has, especially the unique cooperative relationship between the movable subassembly that includes the workpiece, tube, bending head and stop and the fixed one that encompasses the vise, actuating mechanism for the latter, fixed block, bed and template.

It is, therefore, the principal object of the present invention to provide a novel and improved tube bending apparatus.

A second objective is the provision of a device of the character described which is ideally suited for use in quickly and accurately forming a number of essentially identical parts, especially those complex ones having several bends at different angles, spacings and orientations to one another.

Another object of the invention herein disclosed and claimed is to provide a tubing bender designed for use with interchangeable templates that reproducibly locates each successive bend in precise longitudinal position relative to the others.

Still another object of the within described invention is to provide a bending machine for tublular stack which permits successive bends to be made in the workpiece without having to remove the workpiece therefrom between operations.

An additional objective is the provision of a pipe and tubing bender which can accommodate pipe of various sizes, wall thicknesses and lengths while, at the same time, remaining both fast and accurate.

Further objects of the invention forming the subject matter hereof are to provide an apparatus for bending tubing and the like that is simple and easy to use, requires a minimum of set up time, is safe, dependable, compact, reliable, rugged and even somewhat decorative.

Others objects will be in part apparent and in part pointed out specifically hereinafter in connection with the description of the drawings that follows, and in which.

Figure 1:
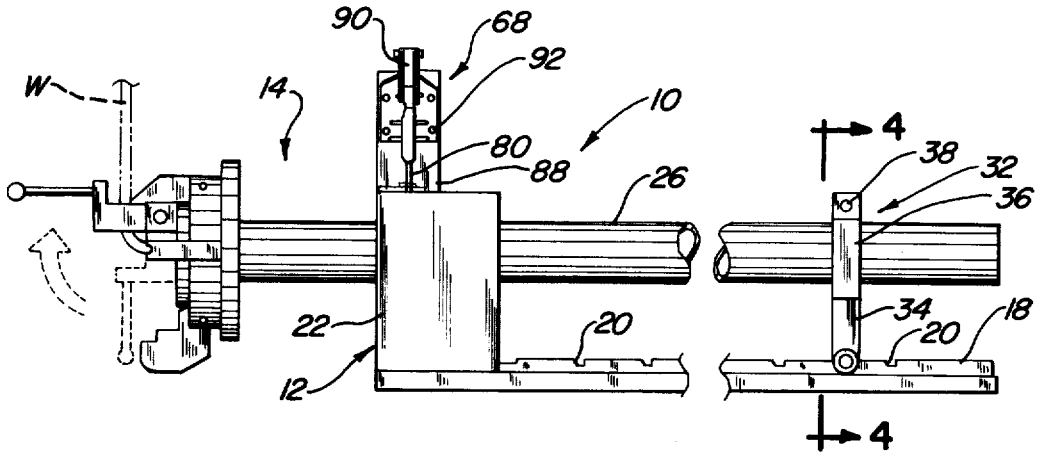
FIG. 1 is a side elevation, portions of which have been broken away to conserve space.
Figure 2:
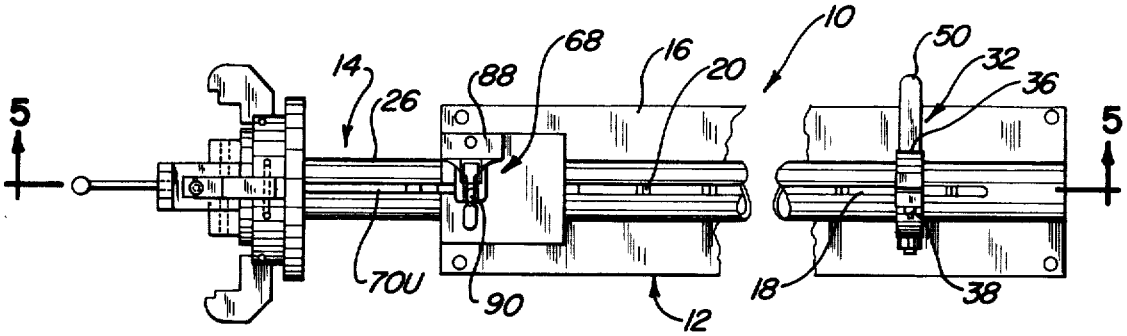
FIG. 2 is a top plan view to the same scale as FIG. 1 and also having portions thereof broken away to conserve space.
Figure 3:
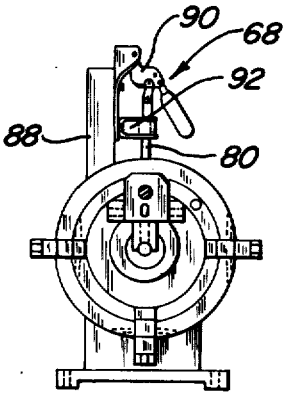
FIG. 3 is an end view.

Referring next to the drawings for a detailed description of the present invention and, more particularly, to FIGS. 1, 2 and 3 for this purpose, reference numeral 10 represents the tube bending machine in its entirety while numeral 12 has been employed to similarly designate a fixed subassembly thereof and numeral 14 a movable subassembly that slides to and for longitudinally relative to the aforesaid fixed subassembly. The fixed subassembly 12 includes a horizontally-disposed bedplate 16 atop which is detachably fastened an interchangeable template 18–18*a* along the length of which are located a series of notches 20 spaced in accordance with a predetermined spacing between bends. This template is shown formed in two parts, 18 and 18*a*, section 18*a* comprising a spacer of known dimension that is interchangeable and functions as a gauge block. Fastened atop what will be denominated here as the head end of the bed is an upstanding block 22 having a horizontally-disposed longitudinally extending cylindrical bore 24 therethrough mounting hollow tubular slide 26 for longitudinal slidable movement in spaced parallel relation above the bed. Each of the notches 20 in the template has a vertically disposed shoulder 28 at the rear end thereof facing block 22 and a forwardly sloping shoulder 30 at its front end, all of which is most clearly revealed in FIG. 5.

Next, with reference to FIGS. 1, 2, 4 and 5, the tubular slide 26 will be seen to carry an adjustable combination stop and slide support mechanism which has been designated in a general way by reference numeral 32. It includes a frame 34 with a split-ring collar 36 at its upper end which clampingly engages slide 26 and is fastened in selected positions along its length by means of screw 38 that draws the halves of the ring together in the well-known manner. The underside of frame 34 is notched as shown at 40 in FIG. 4 to loosely receive the template 18 resting atop the bed. Stub shafts 42 project from opposite side margins of the frame 34 and carry rollers 44 which roll along the bed alongside the template. These rollers cooperate with the frame to support the portion of the slide overhanging the bed.

Figure 4:
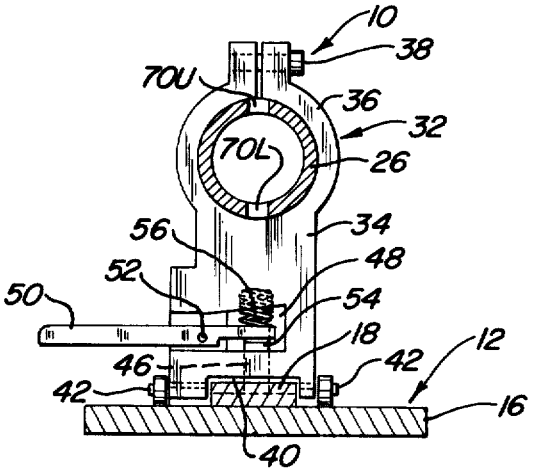
FIG. 4 is a section taken along line 4—4 of FIG. 1 to a slightly enlarged scale.
Figures 5, 6, 7, 8, 9:
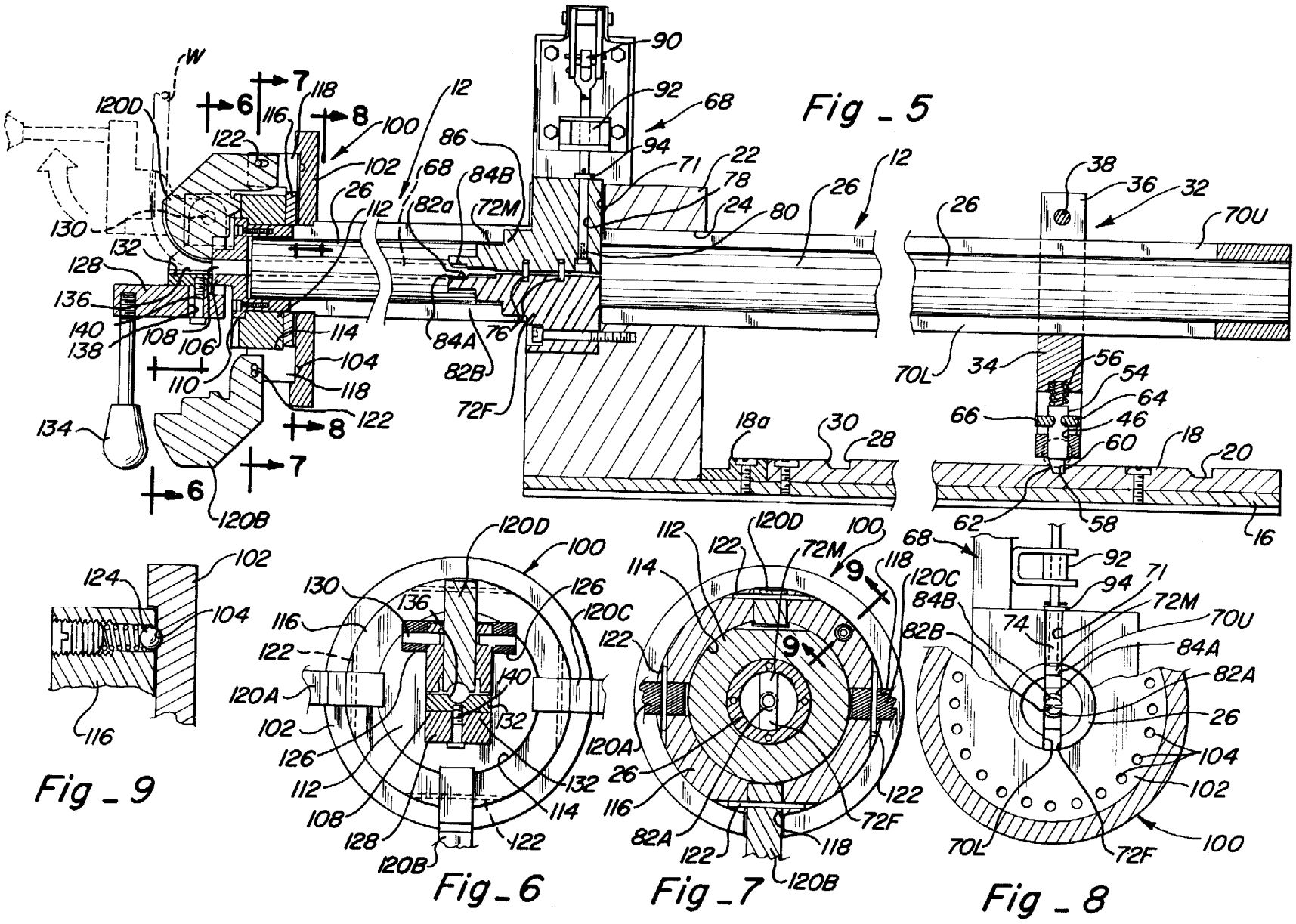
FIG. 5 is a section taken along line 5—5 of FIG. 2 to a greatly enlarged scale, so large in fact that portions have been broken away to conserve space.
FIG. 6 is a fragmentary section taken along line 6—6 of FIG. 5.
FIG. 7 is a fragmentary section taken along line 7—7 of FIG. 5.
FIG. 8 is a fragmentary section taken along line 8—8 of FIG. 5.
FIG. 9 is a fragmentary section to a still further enlarged scale taken along line 9—9 of FIG. 7.

Now, in FIGS. 4 and 5 it can be seen that the underside of the frame 34 has a vertically-disposed socket 46 therein that opens onto notch 40. Intersecting this socket is a transverse slot 48 in which is mounted a bifurcated rocker arm 50 for pivotal movement about a horizontal axis 52 located intermediate its ends. Mounted for vertical movement within socket 46 is a pin detent 54. A compression spring 56 housed within the socket normally biases the detent into extended position where the tip 58 thereof slides along the top of the template and can enter any one of the notches 20 therein. The rear edge 60 of this tip is shaped to cooperate with the corresponding shoulder 28 of the notch 20 to limit the movement of the slide in a direction to retract same when the pin is released into extended position, all of which can be seen in FIG. 5. On the other hand, the front edge 62 of the tip of the detent is inclined to define a cam surface complementary to sloping surface 30 of the template notch. Movement of the slide in a direction to extend same will cause cam surface 62 to ride up over sloping ramp 30 on the front edge of the notch thus automatically retracting the detent against the bias exerted thereon by compression spring 56. Manual retraction of the detent is accomplished by actuation of rocker arm 50 which tilts about its pivot 52 and the forked end 64 thereof engaged in the notches 66 in the sides of the detent raises the detent against the extending bias of the compression spring.

The clamp subassembly by means of which the workpiece W is releasably held in the movable subassembly 12 against both relative longitudinal and rotational movement has been designated in a general way by reference numeral 68 and it can best be seen in FIGS. 3 and 5 to which detailed reference will now be made. The slide 26 is longitudinally slotted both top and bottom almost its entire length. Slot 70U on the top of the slide parallels and is diametrically-disposed to slot 70L along the bottom.

Bolted into the vertical wall of a slot 71 in the face of block 22 is a fixed jaw 72F positioned and shaped to ride within lower slot 70L of the slide thus permitting the latter to move relative thereto. This fixed jaw also functions as a key riding within the keyway defined by lower slot 70L to keep the slide from rotating. A movable jaw 72M is, likewise, housed within the interior of the slide in position to rest atop and mate with fixed jaw 72F. This movable jaw includes a portion 74 that extends upwardly through the upper slot 72U and also through the slot 71 in the front face of the block 22 that communicates with the bore 24 therein while opening onto the top thereof, all of which is most clearly revealed in FIG. 8.

Movable jaw 72M contains a vertically-disposed opening 78 that houses a push rod 80 which functions upon actuation to lower the movable jaw in a manner to be described presently.

The movable jaw 72M merely rests atop the fixed one 72F and must be pressed into gripping engagement therewith and with the workpiece W; however, a pair of longitudinally spaced parallel pins 76 keep the jaws aligned. The mouth 82 of the jaws within which the workpiece W is secured has flared entryways **84*a* and 84*b* at the entrance to each section 82*a* and 82*b* thereof that will function to spread the jaws apart when the workpiece is pressed thereagainst. In the particular form shown, the mouth of the jaws comprise a stepped bore having a large diameter forward section 82*a* and a smaller diameter rear section 82*b* arranged in end-to-end coaxial relation with one another and with the axis of tubular slide 26 when the jaws are closed upon a workpiece. The axis of the mouth of the fixed jaw lies permanently on the slide tube axis where that of the movable jaw obviously does not. The stepped mouth, of course, accommodates tubing and pipe of different outside diameters and it may include several such steps rather than just two of them. Note also that the mouth has a blind rear end 86** so that the tubing does not extend all the way through the jaws, but rather, a known distance in front thereof.

Fastened atop the block 22 alongside slot 71 therein is located an upstanding support member 88 to which is attached a conventional toggle-type over center latch 90. An apertured guide member 92 for the push rod 80 is mounted directly beneath the latch to support the push rod for reciprocating movement. The latch is fastened to the upper end of the push rod and functions upon actuation to raise and lower same. The push rod carries a shoulder 94 (FIG. 5) which presses down upon the movable jaw and urges the latter into clamped engagement with the workpiece upon actuation in a direction to lower the rod. The over center toggle action of the latch keeps the jaws closed upon the workpiece until the bending operations have been completed. Once secured, the workpiece is fixed against both longitudinal and rotational movement which is a unique feature of the instant bending tool.

Referring next to all of the figures of the drawings except FIG. 4, the novel bending head which has been broadly designated by numeral 100 will be described in detail. Permanently attached to the slide tube in spaced relation to its front end is a circular flange 102, the front surface of which contains a series of dimples 104 arranged in a circle 15° apart. Other spacings may, of course, be used but these are sufficient to accommodate most pipe bending applications. This flange is, of course, free to move longitudinally with the slide but, being fixedly attached thereto, neither can rotate.

Detachably bolted to the front end of slide tube 26 is an interchangeable tube alignment guide 106 having an axial opening 108 therein arranged in coaxial relation to the slide tube axis and sized to receive the outside diameter of the workpiece with a free sliding fit. This guide member is, of course, changed to accommodate different sizes of pipe and tubing. A marginal flange 110 rims this guide member and projects radially beyond the outside diameter of the slide tube where it serves as a retainer for ring 112.

Ring 112 sits within a circular recess 114 in the front face of a radially-slotted circular plate 116 which abuts plate 102 in face-to-face relation. Plate 116 has one or more radial slots 118 angularly spaced around the edge thereof within which are hingedly mounted interchangeable anvils **120*a*, 120*b*, 120*c* and 120*d*. These anvils are hinged on chordal hinge pins 122 that extend across the slots in plate 116 as shown most clearly in FIG. 7. Each of these four anvils is different, anvil 120*d* being shaped for a 90° bend as shown in phantom lines in FIG. 5. Anvil 120*d* is the only one of the four shown rotated inwardly into its operative position alongside the workpiece W, the other three having been shown flipped back out of the way (see die 120*b* in FIG. 5**).

Plate 116 is free to rotate relative to fixed plate 102; however, a spring biased ball detent 124 shown in FIG. 9 releasably holds these plates in face-to-face adjusted relation by entering a selected dimple 104 as shown. Thus, by rotating plate 116, any one of the four anvils can be brought into any desired angular position relative to the workpiece. In the particular arrangement shown, anvil **120*d*** is positioned to bend the workpiece upwardly at right angles to the bed.

Now, ring 112 has a pair of integrally formed ears 126 projecting forwardly therefrom between which is hingedly mounted the bifurcated forming die 128 for pivotal movement about transverse pivot pin 130. Pin 130 lies at the center of the arc defined by the curved surface of the anvil around which the workpiece is bent. In the open position shown in full lines in FIG. 5, the forming die will be seen to include a grooved block 132 that cradles the workpiece and whose axis is coaxial with bore 108 of the guide member 106. The construction and function of this block will be described presently.

The bifurcated portion of the forming die 130 is slotted to receive the selected anvil **120*d* which, in operative position, releasably locks ring 112 to plate 114 for conjoint rotation. In other words, once the proper die has been chosen, ring 112 is rotated to the position it occupies on the edge of plate 116**, whereupon, the die is swung into its operative position within the slot in the forming die. This action locks the ring and plate together and the subassembly thus formed can be turned to whatever angular position needed for making the next bend.

Reference numeral 134 is an operating handle attached to the forming die and it is used to rotate said die around its pivot 130. With the workpiece W secured between the jaws of the clamping subassembly 68 and projecting out through guide member 106 alongside the forming die in open position, the operator need only grasp handle 134 and rotate the die around its pivot 130 to make the desired bend. The anvil, of course, cradles and supports the pipe while the bend is being made.

Now, upon completion of the bend, the groove 136 in block 132 rubs against the surface of the bend thus formed and has a tendency to scrape and "hang-up"on it unless provision is made for eliminating this problem. It has been found in accordance with the teaching of the instant invention that mounting block 132 on the face of forming die 128 with a "lost motion" connection eliminates this sticking problem. The forming die is longitudinally slotted as shown at 138 and a pin 140 moves within said slot and also defines the means for attaching the block 132 thereto.

As the forming die is swung around on the bending stroke, the grooved block 132 and its associated pin 140 slides to the end of slot 138 closest to the tube alignment guide 106 as shown in FIG. 5. The grooved block remains in this position until the bend is completed. Upon the return of the forming die to the full line position of FIG. 5, on the other hand, the block 132 stays in position against the bend thus formed until pin 140 is contacted by the remote end of slot 138. At this point, the forming die has swung away to a position where it has released the block from contact with the bend in the tube and it no longer hangs up thereon.

Ordinarily, the initial bend would be made with the slide extended to the point where detent 58 lays in the forward most notch 20 of the template. If the workpiece is pre-cut to length and abutted up snug against the blind end 86 of mouth 82 in the clamping subassembly 68, then the initial bend should be made at precisely the right point on the workpiece provided, of course, that the detent subassembly 32 has been properly positioned along the slide. Once the first bend has been made and with the workpiece still clamped in place, the forming die can be retracted into its inoperative position shown in full lines in FIG. 5, whereupon, the slide and head subassembly can be retracted as a unit upon release of the detent 58 by actuating release lever 50. The head will slide back along the workpiece until spring biased detent 58 falls into the second notch 20 in the template. The spacing between the first and second notches, of course, corresponds to the predetermined spacing between the first and second bends.

In getting ready to make the second bend, it may be at an angle to the first and also be of a shorter or longer arc. If, for instance, it is a 40° bend instead of a 90° one, then the 90° anvil will be swung out of the way and the bending head 128 rotated to the position occupied by the 45° anvil, whereupon it will be swung into the operative position within the slot in the head. Now, if the second bend is at, say, 30° clockwise relative to the first, the subassembly that includes the forming die, 45° anvil, ring 112 and plate 116 will be rotated clockwise two increments assuming a spacing of 15° between dimples as illustrated. The apparatus is ready at this point to make the second bend. One after the other, the entire series of bends is made until, finally, toggle latch 90 is actuated to open the jaws and release the workpiece.

If the same piece is to be duplicated, the slide can be reset to the first notch by just giving it a push forwardly as the detent 58 will ride up out of the notches without having to actuate release lever 50. On the other hand, if a different piece is to be fabricated, a different template will have to be fastened temporarily in place atop the bed. Also, if the tubing has a different outside diameter, a different guide member 106 will have to be fastened to the head or forward end of the slide.

What is claimed is:

1. Apparatus for bending tubular goods comprising: a bedplate having an upwardly facing surface; an upstanding support member attached atop said bedplate, said support member having a horizontally-disposed bore therethrough; a tubular slide mounted within the bore for longitudinal slidable movement in overhanging relation above the upwardly facing surface of the bedplate, said slide having a pair of diametrically-opposed parallel slots extending in the direction of the length thereof; releasable stop means carried by the slide and coacting with the bedplate to temporarily hold said slide in selected longitudinal positions; clamping means associated with the support member including opposed jaws disposed within the slots in the slide for relative movement toward and away from one another, said jaws preventing rotational movement of the slide relative to the support member while permitting relative longitudinal movement therebetween, and said jaws being operative upon actuation to clamp upon a tubular workpiece and hold same in coaxial relation within the slide for conjoint longitudinal movement; means for actuating the jaws of the clamping means; means carried by the slide in longitudinally spaced relation to the jaws of the clamping means coacting therewith to maintain the workpiece in coaxial relation; a radial flange fastened to one end of the slide; a first ring mounted for rotational movement in face-to-face coaxial relation to said flange; means interconnecting said first ring and flange for releasably maintaining them in selected angularly adjusted positions; arcuately-grooved anvil-forming means depending from said first ring for rotational movement therewith and hinged movement relative thereto between a disengaged position and an operative position in supporting relation to that portion of a tubular workpiece projecting beyond the adjacent end of the slide; a second ring mounted on the side for relative rotational movement thereto and to said first ring; means defining a bending tool mounted on said second ring for rotational movement therewith and for independent hinged movement relative thereto and to the anvil when rotated into a position in opposed relation to the groove in the latter, said tool cooperating with said anvil upon actuation to bend a workpiece located therebetween through at least a portion of the arc defined by the groove in the latter.

2. The tube bending apparatus as set forth in claim 1 in which: one jaw of the clamping means is fixed and the other movable, the jaws mate in closed position to define a generally-cylindrical workpiece receiving socket coaxial with the slide, and in which the socket thus formed is blind at one end.

3. The tube bending apparatus as set forth in claim 1 in which: the bedplate includes a template detachably connected to the upwardly facing surface thereof, said template including two or more notches in the upper surfaces thereof arranged in longitudinally spaced relation to one another; and, in which the releasable stop means carries a retractable detent operative in extended position to enter one of the notches in the bedplate upon longitudinal movement of the slide.

4. The tube bending apparatus as set forth in claim 1 in which: the stop means includes at least one roller positioned to roll along the upwardly facing surface of the bedplate defining a support for the overhanging end of the slide.

5. The tube bending apparatus as set forth in claim 1 in which: the stop means includes a split ring clampingly engaging the slide and providing for relative longitudinal adjustment therebetween.

6. The tube bending apparatus as set forth in claim 1 in which: the means interconnecting said ring and flange comprises a spring biased ball detent carried by one of said members and a series of dimples on the other of said members located to receive said ball in selected angular positions.

7. The tube bending apparatus as set forth in claim 1 in which: the means for holding the workpiece centered comprises a centrally apertured plug for the side bordered by a marginal flange effective to cooperate with the radial flange to maintain the first and second rings in assembled relation.

8. The tube bending apparatus as set forth in claim 1 in which: the axis of arcuate movement of the bending tool is coincident with the axis of curvature of the arcuate portion of the groove in the anvil means.

9. The tube bending apparatus as set forth in claim 1 in which: the clamping means includes a fixed jaw and a movable jaw; and, in which the means for actuating the clamping means comprises a push rod mounted for reciprocating movement between a retracted inoperative position and an extended operative position urging said movable jaw toward said fixed jaw, and latchable lever means connected to said push rod operative upon actuation to releasably maintain same in extended position.

10. The tube bending apparatus as set forth in claim 1 in which: the anvil means in connected to the first ring by means of a pin and slot hinge connection effective to permit said anvil to move toward and away from said ring when in operative position.

11. The tube bending apparatus as set forth in claim 1 in which: the bending tool includes a grooved block positioned to engage the workpiece, said block being attached to said tool for limited longitudinal slidable movement so as to define a lost motion connection effective to release the workpiece after a bend has been made therein and the bending tool is returned to its original position.

12. The tube bending apparatus as set forth in claim 2 in which the socket is stepped to receive more than one size workpiece.

13. The tube bending apparatus as set forth in claim 3 in which the notches include an inclined endwall and a perpendicular endwall, said inclined endwall defining a cam surface operative to release the releasable stop means upon movement of the slide in the direction of the support member.

* * * * *